US006044774A

United States Patent [19]

Gelbart

[11] Patent Number: 6,044,774

[45] Date of Patent: Apr. 4, 2000

[54] PADDED TABLE TOP CORNER PROTECTOR SYSTEM

[76] Inventor: Ida Gelbart, 129 Meadowcreek Dr., Corte Madera, Calif. 94925

[21] Appl. No.: 09/309,778

[22] Filed: May 11, 1999

[51] Int. Cl.[7] ..... A47B 95/00

[52] U.S. Cl. ..... 108/90; 248/345.1

[58] Field of Search ..... 108/90, 27; 248/345.1; 150/158; 52/3

[56] References Cited

U.S. PATENT DOCUMENTS

| | | | |
|---|---|---|---|
| D. 377,312 | 1/1997 | Runaldue | D8/402 |
| 1,219,790 | 3/1917 | Taylor | 108/90 |
| 3,144,236 | 8/1964 | Clanin | 248/345.1 X |
| 4,817,902 | 4/1989 | Mason | 108/27 X |

*Primary Examiner*—Janet M. Wilkens

[57] ABSTRACT

A table top corner protector comprising a cord with a central extent and a pad of a triangular configuration located over the corner of a table. The pad is formed from an initial sheet to form a composite fabric with parallel long edges and parallel short edges. A central extent of the cord is positioned over each composite fabric from the lower left corner to adjacent the midpoint of the right long edge and with the lower right edge folded over to the midpoint of the long left edge to form a first pocket edge. Diagonal stitching from adjacent to the lower left edge to adjacent to the midpoint of the long right edge forms a supporting tunnel for the cord. The upper right hand corner is folded to the midpoint of the left long edge to form a second pocket edge and the upper left hand corner is folded down over the left hand right corner. Vertical stitching along the long left edge retains the composite fabric in an orientation for being received by the corners of the table with the coupling cords hanging downwardly from the table top between the corners.

4 Claims, 3 Drawing Sheets

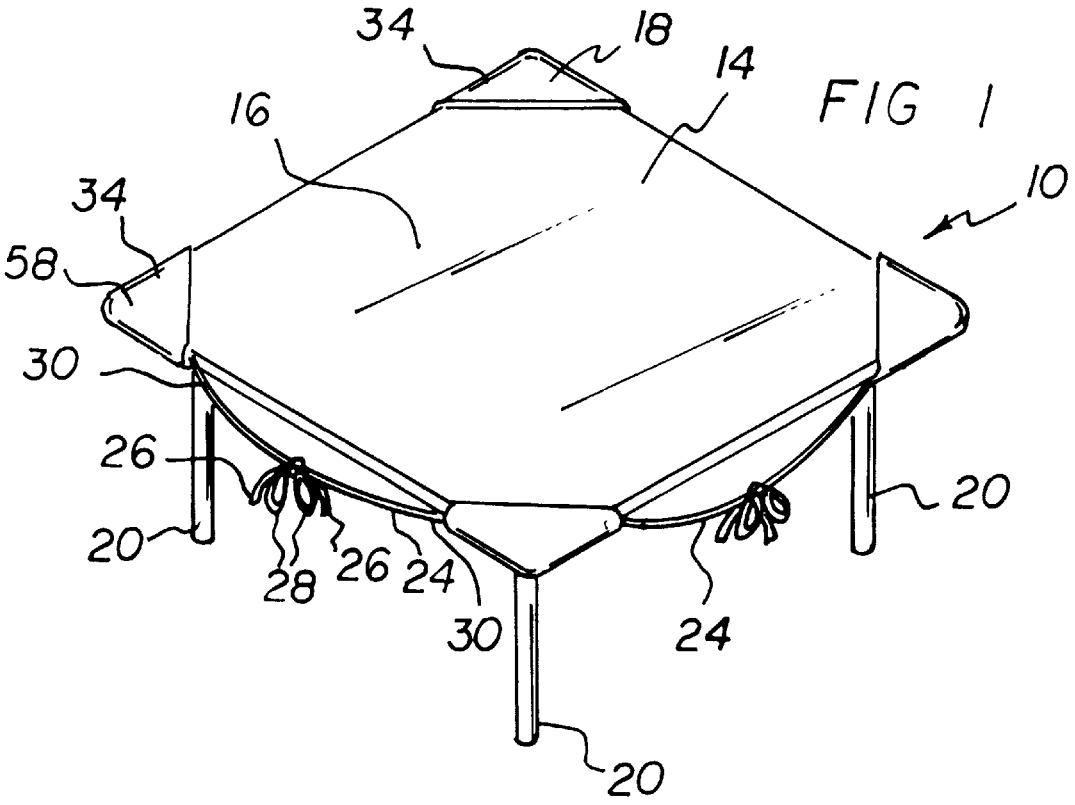
FIG 1
FIG 2
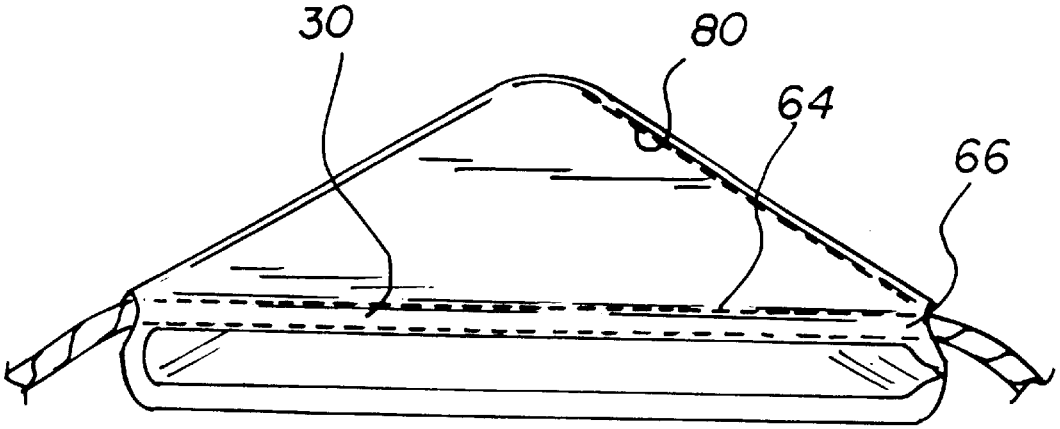

PADDED TABLE TOP CORNER PROTECTOR SYSTEM

BACKGROUND OF THE INVENTION

1. Field of the Invention

The present invention relates to a padded table top corner protector system and more particularly pertains to providing safety to the corner of tables through padded corner protectors for protecting children from injury and for protecting the table from being marred.

2. Description of the Prior Art

The use of table pads and protectors of known designs and configurations is known in the prior art. More specifically, table pads and protectors of known designs and configurations heretofore devised and utilized for the purpose of protecting children from injury resulting from table corners as well as protecting the table corners themselves through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. Des. 377,312 issued Jan. 14, 1997, to Runaldue discloses a padded edge covering for furniture. Lastly, U.S. Pat. No. Des. 330,159 issued Oct. 13, 1992, to Dodds discloses a furniture protector.

While these devices fulfill their respective, particular objectives and requirements, the aforementioned patents do not describe a that allows providing safety to the corner of tables through padded corner protectors for protecting children from injury and for protecting the table from being marred.

In this respect, the padded table top corner protector system according to the present invention substantially departs from the conventional concepts and designs of the prior art, and in doing so provides an apparatus primarily developed for the purpose of providing safety to the corner of tables through padded corner protectors for protecting children from injury and for protecting the table from being marred.

Therefore, it can be appreciated that there exists a continuing need for a new and improved padded table top corner protector system which can be used for providing safety to the corner of tables through padded corner protectors for protecting children from injury and for protecting the table from being marred. In this regard, the present invention substantially fulfills this need.

SUMMARY OF THE INVENTION

In view of the foregoing disadvantages inherent in the known types of table pads and protectors of known designs and configurations now present in the prior art, the present invention provides an improved padded table top corner protector system. As such, the general purpose of the present invention, which will be described subsequently in greater detail, is to provide a new and improved padded table top corner protector system and method which has all the advantages of the prior art and none of the disadvantages.

To attain this, the present invention essentially comprises a new and improved padded table top corner protector comprising, in combination a table. The table has a rectangular top of a rigid material with four corners in a generally horizontal orientation. The table has four legs depending from the lower surface of the top adjacent to the corners of the top. Four cords with free ends are coupled together by bows. Each cord has a central extent between the free ends. A pad is located over each corner. Each pad is of a common triangular configuration and is formed from an initial sheet of a thick padded layer and a thin material layer. The layers are each about 16 inches in length and about 8 inches in width. The layers are bonded together over facing surfaces to form a composite fabric. The composite fabric has parallel long edges and parallel short edges. A central extent of each cord is positioned over each composite fabric from the lower left corner to adjacent the midpoint of the right long edge and with the lower right edge folded over to the midpoint of the long left edge to form a first pocket edge at the hypotenuse thereby formed. Diagonal stitching is applied from adjacent to the lower left edge to adjacent to the midpoint of the long right edge to form a supporting tunnel for the cord positioned there between. The upper right hand corner is then folded to the midpoint of the left long edge to form a second pocket edge at the hypotenuse thereby formed. The upper left hand corner is then folded down over the left hand right corner. Lastly, vertical stitching is applied along the long left edge to retain the composite fabric in an orientation for being received by the corners of the table. The coupling cords hang downwardly from the table top between the corners.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved padded table top corner protector system which has all of the advantages of the prior art table pads and protectors of known designs and configurations and none of the disadvantages.

It is another object of the present invention to provide a new and improved padded table top corner protector system which may be easily and efficiently manufactured and marketed.

It is further object of the present invention to provide a new and improved padded table top corner protector system which is of durable and reliable constructions.

An even further object of the present invention is to provide a new and improved padded table top corner protector system which is susceptible of a low cost of manufacture with regard to both materials and labor, and which accordingly is then susceptible of low prices of sale to the consuming public, thereby making such padded table top corner protector system economically available to the buying public.

Even still another object of the present invention is to provide a padded table top corner protector system for providing safety to the corner of tables through padded corner protectors for protecting children from injury and for protecting the table from being marred.

Lastly, it is an object of the present invention to provide a new and improved table top corner protector comprising a cord with a central extent located over the corner of a table, the pad being of a triangular configuration and from an initial sheet to form a composite fabric with parallel long edges and parallel short edges, a central extent of the cord being positioned over each composite fabric from the lower left corner to adjacent the midpoint of the right long edge and with the lower right edge folded over to the midpoint of the long left edge to form a first pocket edge, diagonal stitching from adjacent to the lower left edge to adjacent to the midpoint of the long right edge to form a supporting tunnel for the cord, the upper right hand corner being folded to the midpoint of the left long edge to form a second pocket edge and the upper left hand corner being folded down over the left hand right corner, and with vertical stitching along the long left edge retaining the composite fabric in an orientation for being received by the corners of the table with the coupling cords hanging downwardly from the table top between the corners.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the new and improved padded table top corner protector system constructed in accordance with the principles of the present invention.

FIG. 2 is an elevational view of one of the corners and pads.

The same reference numerals refer to the same parts throughout the various Figures.

DESCRIPTION OF THE PREFERRED EMBODIMENT

Figure 3:
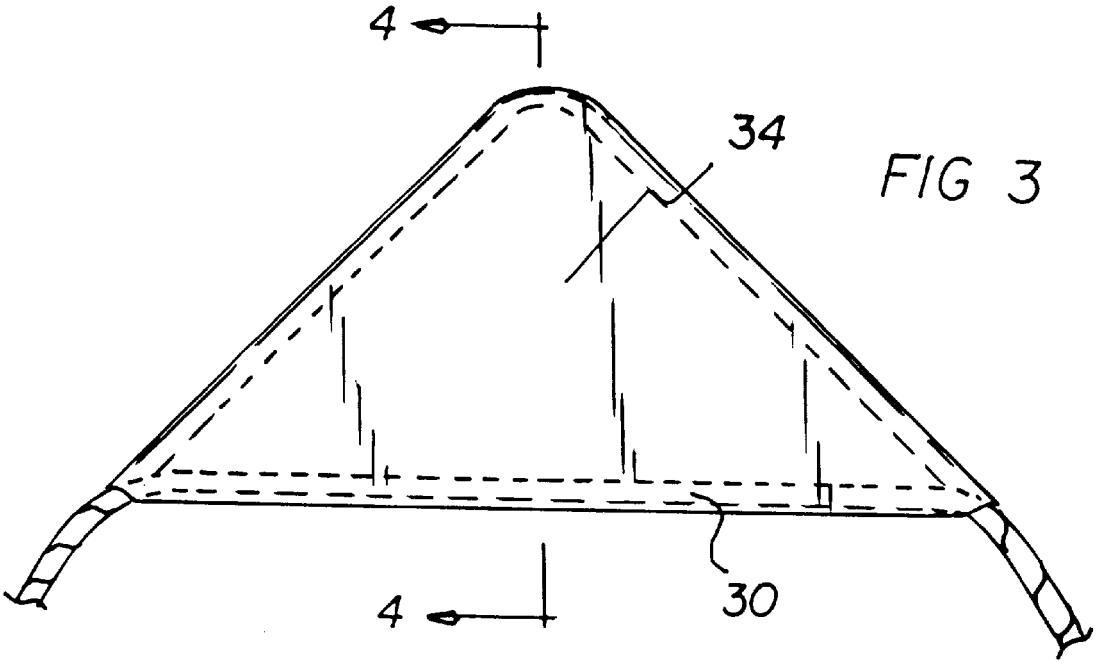
FIG. 3 is a top elevational view similar to that shown in FIG. 2.
Figure 4:
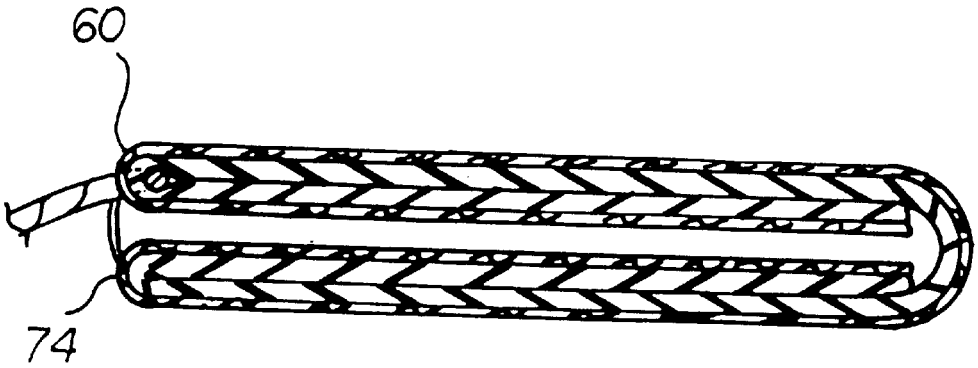
FIG. 4 is a cross-sectional view taken along line 4–4 of FIG. 3.
Figure 5:
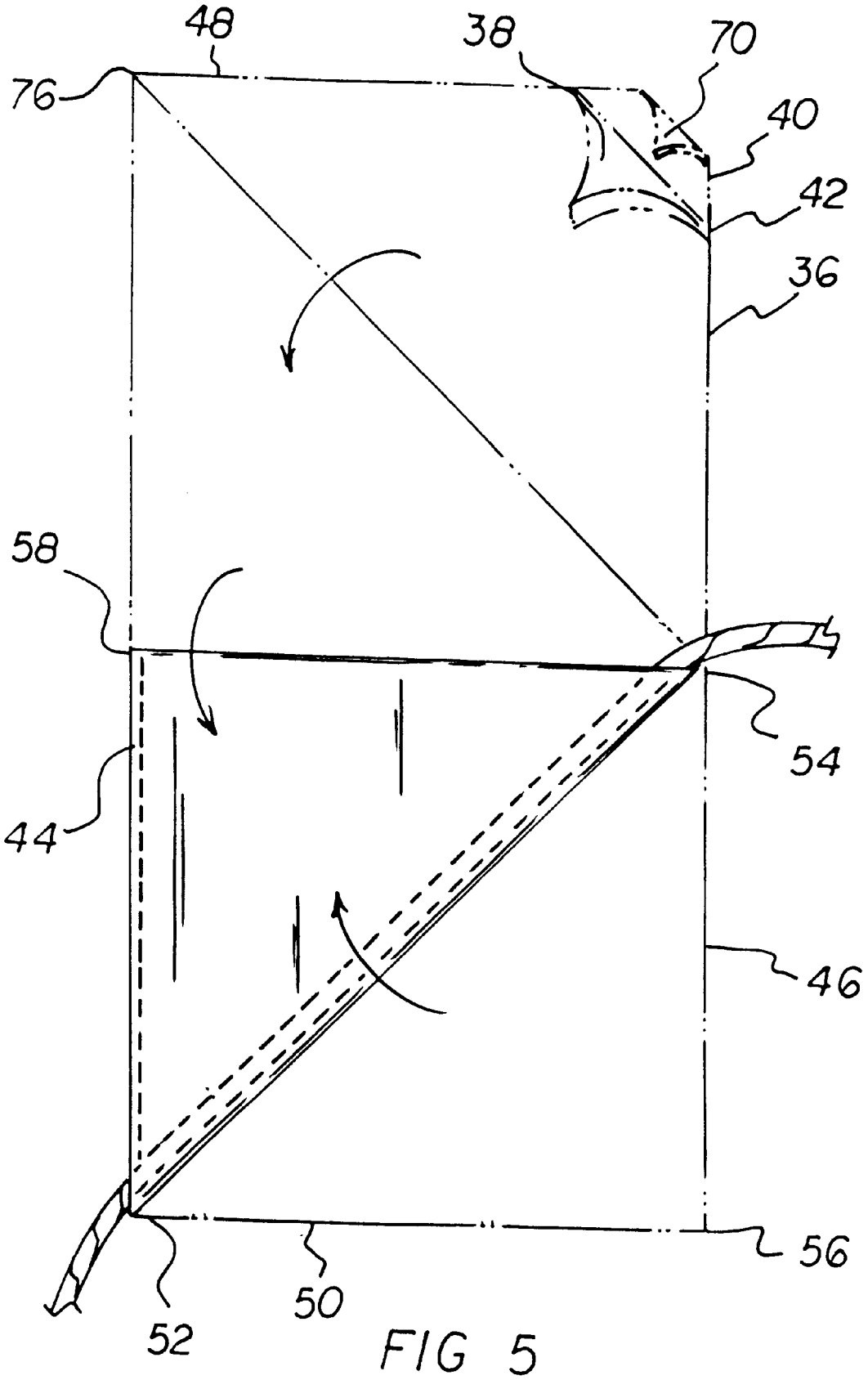
FIG. 5 is a top elevational view of the compass of fabric being folded to form the corner protectors of the prior figures.

With reference now to the drawings, and in particular to FIG. 1 thereof, the preferred embodiment of the new and improved padded table top corner protector system embodying the principles and concepts of the present invention and generally designated by the reference numeral 10 will be described.

The present invention, the new and improved padded table top corner protector system 10 is comprised of a plurality of components. Such components in their broadest context include a table, a cord, a pad, diagonal stitching from adjacent to the lower left edge to adjacent to the midpoint of the long right edge, the upper right hand corner being folded to the midpoint of the left long edge and the upper left hand corner being folded down over the left hand right corner, and vertical stitching along the long left edge. Such components are individually configured and correlated with respect to each other so as to attain the desired objective.

A table 14 has a rectangular top 16 of a rigid material with four corners 18 in a generally horizontal orientation. The table has four legs 20 depending from the lower surface of the top adjacent to the corners of the top.

Four cords 24 with free ends 26 are coupled together by bows 28. Each cord has a central extent 30 between the free ends.

A pad 34 is located over each corner. Each pad is of a common triangular configuration and is formed from an initial sheet 36 of a thick padded layer 38 and a thin material layer 40. The layers are each about 16 inches in length and about 8 inches in width. The layers are bonded together over facing surfaces to form a composite fabric 42. The composite fabric has parallel long edges 44, 46 and parallel short edges 48, 50. A central extent of each cord is positioned over each composite fabric from the lower left corner 52 to adjacent the midpoint 54 of the right long edge and with the lower right edge 56 folded over to the midpoint 58 of the long left edge to form a first pocket edge 60 at the hypotenuse thereby formed.

Diagonal stitching 64 is applied from adjacent to the lower left edge to adjacent to the midpoint of the long right edge to form a supporting tunnel 66 for the cord positioned there between.

The upper right hand corner 70 is then folded to the midpoint of the left long edge to form a second pocket edge 74 at the hypotenuse thereby formed. The upper left hand corner 76 is then folded down over the left hand right corner.

Lastly, vertical stitching 80 is applied along the long left edge to retain the composite fabric in an orientation for being received by the corners of the table. The coupling cords hang downwardly from the table top between the corners.

In an alternate embodiment the pad may be formed of a single padded composite fabric, rather than the two layers of fabric bonded together as in the preferred embodiment.

The fabric and cords of the present invention may be of many colors and designs so that the table top corner protector can be adapted to function to protect the table top as well as avoid injury to children or adults who might come into contact with the sharp corners of the table and also blend with and enhance any decor. The fabric provided may match or complement draperies, pillows, upholstery, or the like in a room. The fabric may be relatively thin or greatly padded depending upon the amount of protection designed and the look to be achieved. By adding or changing the table top corner protector a new look may be achieved.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved padded table top corner protector system comprising, in combination:

a table having a rectangular top of a rigid material with four corners in a generally horizontal orientation and with four legs depending from the lower surface of the top adjacent to the corners thereof;

four cords with free ends coupled together by bows and with each cord having a central extent between the free ends;

a pad located over each corner, each pad being of a common triangular configuration and formed from an initial sheet of a thick padded layer and a thin material layer with the layers each being about 16 inches in length and about 8 inches in width and bonded together over facing surfaces to form a composite fabric with parallel long edges and parallel short edges, said central extent of each cord positioned over each composite fabric from the lower left corner to adjacent the midpoint of the right long edge and with the lower right edge folded over to the midpoint of the long left edge to form a first pocket edge at the hypotenuse thereby formed;

diagonal stitching from adjacent to the lower left edge to adjacent to the midpoint of the long right edge to form a supporting tunnel for the cord there between;

the upper right hand corner being folded to the midpoint of the left long edge to form a second pocket edge at the hypotenuse thereby formed and with the upper left hand corner being folded down over the left hand right corner; and vertical stitching along the long left edge to retain the composite fabric in an orientation for being received by the corners of the table with the coupling cords hanging downwardly from the table top between the corners.

2. A corner protector adapted for use with a table top having corners comprising:

a cord with a central extent;

a pad adapted to be positioned over one of the corners of the table top, the pad being of a triangular configuration and formed from an initial sheet to form a composite fabric with parallel long edges and parallel short edges, said central extent of the cord positioned over the composite fabric from the lower left corner to adjacent the midpoint of the right long edge and with the lower right edge folded over to the midpoint of the long left edge to form a first pocket edge;

diagonal stitching from adjacent to the lower left edge to adjacent to the midpoint of the long right edge to form a supporting tunnel for the cord there between;

the upper right hand corner being folded to the midpoint of the left long edge to form a second pocket edge and with the upper left hand corner being folded down over the left hand right corner; and vertical stitching along the long left edge to retain the composite fabric in an orientation adapted for being received by one of the corners of the table top with the cord hanging downwardly from the table top between adjacent corners of the table top.

3. The corner protector as set forth in claim 2 wherein the initial sheet is of a thick padded layer and a thin material layer bonded together over their facing surfaces.

4. The corner protector as set forth in claim 2 wherein the initial sheet is about 16 inches in length by about 8 inches in width.

* * * * *